US005282699A

United States Patent [19]

Hodge

[11] Patent Number: 5,282,699

[45] Date of Patent: Feb. 1, 1994

[54] METHOD AND APPARATUS FOR DENSIFICATION OF SANDS OF SILTS

[75] Inventor: William E. Hodge, Vancouver, Canada

[73] Assignee: Phoenix Engineering Ltd., Vancouver, Canada

[21] Appl. No.: 957,884

[22] Filed: Oct. 7, 1992

[51] Int. Cl.[5] ..... E02D 3/02

[52] U.S. Cl. ..... 405/271; 405/50

[58] Field of Search ..... 405/36, 50, 258, 271, 405/303

[56] References Cited

U.S. PATENT DOCUMENTS

| | | | |
|---|---|---|---|
| 1,215,134 | 2/1917 | Ferry . | |
| 1,878,295 | 9/1932 | Richmond . | |
| 2,176,540 | 10/1939 | Moore . | |
| 2,654,434 | 10/1953 | Culleton . | |
| 2,719,029 | 9/1955 | Steuerman . | |
| 3,309,877 | 3/1967 | Degen . | |
| 3,528,252 | 9/1970 | Gail . | |
| 3,808,823 | 5/1974 | Chelminski | 405/271 |
| 4,112,692 | 9/1978 | Anderson et al. . | |
| 4,260,283 | 4/1981 | Croy . | |
| 4,664,557 | 5/1987 | Hodge . | |
| 4,699,546 | 10/1987 | Massarsch . | |

OTHER PUBLICATIONS

"Loose Sands—Their Compaction By Vibroflotation", Elio D'Appolonia, 1969 A.S.T.M., pp. 138–162.

"Vibroflotation Compaction of Cohesionless Soils", Ralph E. Brown, 1977 J.G.E.D./A.S.C.E., pp. 1437–1451.

Published Japanese patent application Ser. No. 56–4172 of Yoshihiko Kihara entitled "Vibrating Dehydration Promoting System Ground Consolidating Method and Device Thereof".

Published Japanese patent application Ser. No. 57–198874 of Morio Sugano entitled "Dehydration Device of Supersoft Ground".

Published Japanese patent application Ser. No. 58–182876 of Kunio Nakada entitled "Dehydration Type Rod Compaction Method".

"Construction Method for Improving Underwater Sand Fills", W. E. Hodge, Hydraulic Fill Structures Specialty Conference, Fort Collins, Colo., Aug. 15–18, 1988.

"New Equipment for Densification of Granular Soils at Depth", R. G. Companella, R. Hitchman & W. E. Hodge, 42nd Cdn. Geotechnical Conference, Winnipeg, Man., Oct. 1989.

European Patent Application Publicaton No. 318,172 dated May. 31, 1989; (corresponding to South African patent No. 88/8485 granted Jul. 26, 1989 and to Japanese Patent Publication No. 244013/89 dated Sep. 28, 1989).

*Primary Examiner*—David H. Corbin

*Attorney, Agent, or Firm*—Bull, Housser & Tupper

[57] ABSTRACT

Saturated sand or silt is densified at depth by applying a radially propagated lateral translation force within a region of the soil, while water is actively withdrawn from such region toward the point of application of such force. A densification device incorporating the foregoing principle has a mechanism which imparts to the region surrounding the device cyclic lateral displacements which act axi-symmetrically to the longitudinal axis of the device; and, a filtered cavity and pumping mechanism for withdrawing water from the region surrounding the device.

20 Claims, 1 Drawing Sheet

METHOD AND APPARATUS FOR DENSIFICATION OF SANDS OF SILTS

FIELD OF THE INVENTION

This application pertains to a method and apparatus for compacting or "densifying" deep deposits of saturated sands or silts by withdrawing water from the sand or silt while simultaneously causing cyclic radial displacement at depth within the body of sand or silt.

BACKGROUND OF THE INVENTION

Loose deposits of sands or silts which exist below the ground-water table are a hazard and require compaction or "densification" before structures are placed thereupon. If this were not done then subsequent settling of such soils (sands and/or silts), or failure of the soils due to liquefaction, beneath the structure would damage the structure and/or endanger the safety of persons or objects within or near the structure.

Where loose saturated sand exists at depth, (typically up to about 50 feet below ground level), a process termed "vibroflotation" is the currently accepted Civil Engineering technique for compacting or "densifying" the sand. There is an established body of literature which deals with vibroflotation, for example *Loose Sands—Their Compaction By Vibroflotation,* Elio D'Appolonia, 1969 A.S.T.M., pp. 138–162. As explained by D'Appolonia at page 139–140, "The process, as the name implies, employs mechanical vibrations and simultaneous saturation with water to move, shake, and 'float' the sand particles into a dense state." D'Appolonia further explains in the text bridging pages 140–141 that water jets aid penetration of the vibroflot device into the sand. Once the vibroflot device has reached the desired depth, additional water is injected to aid in the compaction process. Thus, in practice, densification devices are relatively simple apparatus consisting of an extended conduit which is forced into the ground and then vibrated while water is added to the sand.

In his U.S. Pat. No. 4,664,557 entitled "Method and Apparatus for Constructing an Underwater Fill", Hodge introduced the idea of pumping water out of a submerged sand pile, while it is being constructed, to improve the engineering properties of the resulting sand mass. Pumping water out of the interior of the sand mass induces water to flow in through the outside faces of the accumulating sand pile. This circulation of water during the building process creates seepage forces which support the side slopes of the pile as it is formed, consequently enabling the formation of steeper outside slopes. Increased shear stresses created in the neighbourhood of steeper slopes are believed to promote a denser sand packing.

U.S. Pat. No. 4,699,546 Massarsch discloses a method of densifying a sand through application of a compacting force within the sand. Massarsch provides a perforated pipe which may function to drain water away from the region being compacted, but does not suggest the creation of seepage forces by actively withdrawing water through the region being densified.

The prior art discloses pumping water from a sump during vibratory compaction of a pre-existing soil. See for example published Japanese patent application Serial No. 56-4172 of Yoshihiko Kihara entitled "Vibrating Dehydration Promoting System Ground Consolidating Method and Device Thereof". Kihara provides a perforated pipe which is inserted into the ground and vibrated. Water flows into the pipe, through the perforations, and accumulates in the bottom interior region of the pipe. A pump lowered to the bottom of the pipe is used to discharge water which accumulates there to the surface through a drain hose.

Hodge in his South African patent No. 88/8485 granted 26 Jul. 1989 entitled "Method for Densification of Particulate Masses" (see also European Patent Application Publication No. 318,172 dated 31 May 1989; or, Japanese Patent Publication No. 244013/89 dated 28 Sep. 1989) teaches the benefits of actively withdrawing water from the region close to the application of vibratory densification energy. In that apparatus the drainage device is situated about five feet above the centre of application of the vibratory force. Kihara, like Massarsch or other vibroflotation processes which permit drainage of the ground locate the source of the vibration at the top of the apparatus, far away from the site of the drainage element.

Whereas sands are amenable to treatment by vibratory methods, silts are conventionally treated by the application of sustained static loading, for example temporarily placing a thick layer of sand on the ground surface over the area in question, and then, several months later, removing that sand again. The areal extent of the required "pre-load" increases as the depth to the deleterious soil increases, a fact which affects adjacent properties in many cases.

As saturated soil is made more dense, the spaces between individual grains of soil decrease in volume. The water which occupies those spaces becomes pressurized as the spacing between grains decreases, and this water tends to travel away from the region being densified, to regions of lesser pressure. This surplus water, which surrounds prior art devices, absorbs densification energy wastefully and buffers the effects of the compactive effort on the grains. The presence of entrapped water also delays the readjustment of grains between grains, and this delay means energy is being transmitted during that interval to no effect. Until the surplus water has exited the region, adjacent particles cannot come together in the more compact arrangement which produces a denser soil. The natural rate at which water can vacate the region being densified is of the order of hours in sand and of the order of weeks in silt. This time lag is one of the reasons that current devices are unable to densify silt.

The inventor believes that what is necessary in order to produce denser packing in both sands and silts is to cause particles to translate sub-horizontally relative to particles lying directly above and beneath. This movement must be accomplished to whatever extent possible, in the absence of excess "pore" water. The term "sub-horizontal" is intended to imply a movement which is predominantly horizontal, but with a small vertically downward component (about two to five degrees). This allows particles to move over adjacent grains and to be then pushed, rather than fortuitously fall, into the void spaces between individual grains. The most direct, effective, and consequently, efficient method of accomplishing that objective is to move grains in a sub-horizontal radial direction in the region around the device, while providing for drainage of all surplus water. By restricting the energy output to the specific task of causing translation of soil in the preferred direction simultaneously in all radial directions, the energy is most efficiently utilized. The simultaneous withdrawal of water from the soil complements the translational movements because those aligned hydraulic drag forces exerted by the flowing water on the soil particles pull (attract) the soil particles towards the device in a radial direction.

By contrast the prior art devices are rigid bodied steel pipes without expandable sections; essentially they shake a pipe in the ground. Where they incorporate a drainage element, that drainage element will either fail to prevent silt particles from entering the body of the device, or it will be rendered incapable of admitting water because of smearing of the porous barrier. Also, where drainage elements are incorporated into the design the drain is sufficiently far removed from the focus of the vibratory energy, and the attendant localized pore water pressure generation, that energy and time are both wasted.

SUMMARY OF THE INVENTION

The present invention facilitates densification of sands or silts by causing the sand or silt particles to move into a closer packing arrangement. This is accomplished by disturbing the existing grain arrangement by exerting a cyclical sub-horizontally acting radial displacement which is applied in all radial directions at the same time. This is accomplished with a "volume change chamber" consisting of a flexible-walled section provided at the base of a conduit. The chamber is forced to translate outwardly into the soil mass surrounding the device and then subsequently, and cyclically, collapse inwardly as the force is withdrawn. Existing devices use rigid pipes which are nade to vibrate either vertically or horizontally and consequentially do not cause deformation of the surrounding ground in all radial directions concurrently. These existing devices allow the ground on one side to relax as the ground on the other side is being pushed; while compression is being applied to one side, the opposite side is allowed to fall into relative tension.

The invention incorporates a drainage system which is devised to cause the maximum quantity of water to be sucked out of the soil in the minimum amount of time, while concurrently causing beneficial seepage forces to be aligned with the densification effort. This is accomplished by providing a system in which the pore water can be sucked in through the volume change chamber itself, the point of emanation of the densification effort. By reducing to an absolute minimum the distance pressurized pore water must travel to escape, the time required for water to escape through silts is shortened to an acceptable duration.

The continual flexing of the drainage filter cloth, which comprises the outer skin of the volume change chamber, rids the screen of silt size material (smearing) which would otherwise clog it and render it ineffective. Smearing of the drainage element in prior art devices is a factor which prevents those devices from compacting saturated silts. By alleviating this problem the present invention can compact silts as well as sands.

More particularly, and in accordance with the preferred embodiment hereinafter described, the invention provides an apparatus for densifying a saturated soil region which surrounds the apparatus. The apparatus has a lower section comprising a densification means for imparting to the surrounding region cyclic displacements which act radially and substantially perpendicular to the longitudinal axis of the apparatus. A flexible screening means is provided to exclude sand and silt particles from the apparatus, while permitting water to be withdrawn from the surrounding region through the screening means. A pumping means continuously expels the withdrawn water from the apparatus.

Preferably, the densification means is a volume change chamber. The screening means surrounds the volume change chamber. A motor means is also provided in the lower section of the apparatus, to cause cyclic expansion of the volume change chamber. The motor may be air powered. Advantageously, the motor may be an air-powered reciprocating piston which reciprocates in a direction parallel to the longitudinal axis of the apparatus.

A conduit is provided to convey energy, such as pressurized air, to energize the motor. The conduit may also convey energy to the pumping means. The pumping means may take the form of air being expelled from the motor into the water which is withdrawn through the screening means. In such case, a conduit is provided to convey the expelled air and the water out of the apparatus.

The invention also provides a method of densifying saturated soil in which a cyclic radial displacement which acts sub-horizontally is applied within a region of the soil; and, during application of the displacement, water is actively withdrawn from the region toward the source of application of the displacement.

DETAILED DESCRIPTION OF THE PREFERRED EMBODIMENT

Figure 1:
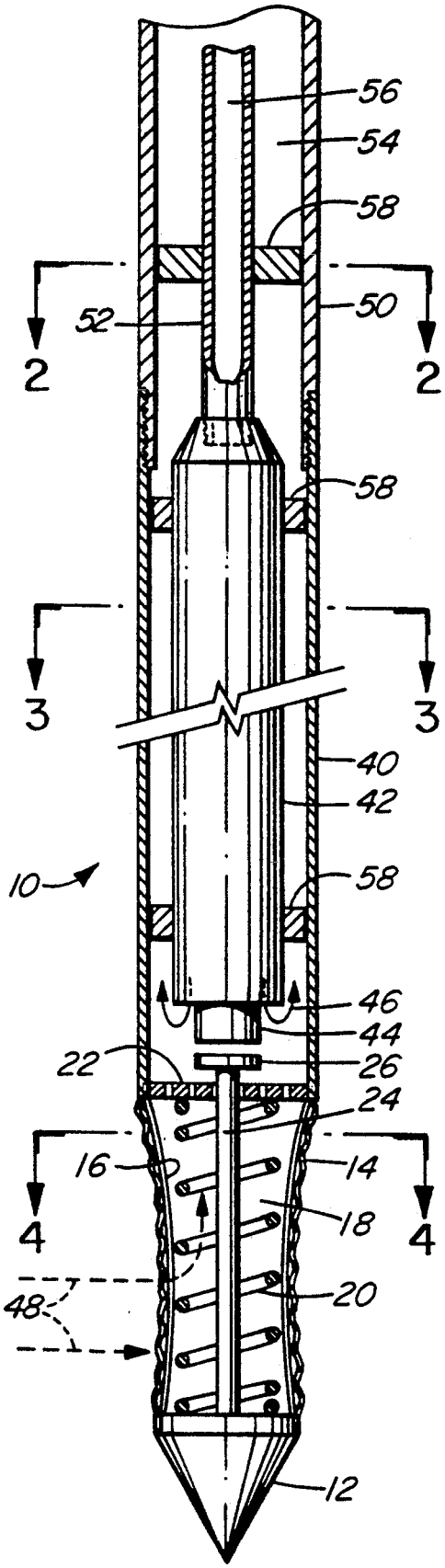
FIG. 1 is a cross-sectional elevation view of a densification device capable of densifying sand or silt in accordance with the preferred embodiment.
Figure 2:
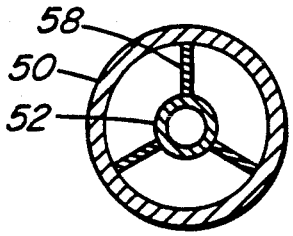
FIG. 2 is a cross-sectional view of the densification device of FIG. 1, taken with respect to line 2—2 of FIG. 1 and completed to show the full cross-section.
Figure 3:
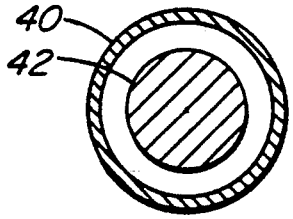
FIG. 3 is a cross-sectional view of the densification device of FIG. 1, taken with respect to line 3—3 of FIG. 1 and completed to show the full cross-section.
Figure 4:
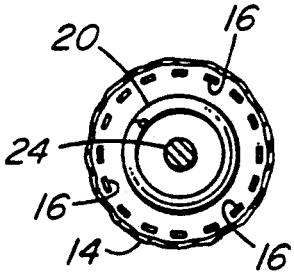
FIG. 4 is a cross-sectional view of the densification device of FIG. 1, taken with respect to line 4—4 of FIG. 1 and completed to show the full cross-section.

The drawings illustrate a densification device generally designated 10. Device 10 has an extended pipe-like configuration with a pointed end 12 which assists in driving device 10 into the ground which is to be compacted or densified. Normally, device 10 will be heavy enough to enter the ground directly when activated as hereinafter explained.

Filter fabric 14, which may be a tough, porous flexible material such as woven polypropylene, is supported against a backing of flexible steel straps 16 to define a cavity 18 at the bottom of device 10. Straps 16 give cavity 18 a truncated cone shape when the cavity is dilated, with the smaller radial dimension being at the bottom. The side walls of cavity 18 are inclined at about two to five degrees off the vertical. Helical spring 20 is compressed within cavity 18 by attachment between driving point 12 and perforated steel plate 22. The opposed ends of each of flexible straps 16 are fixed around the rim of plate 22 and around the upper rim of driving point 12. Connecting rod 24 passes longitudinally through spring 20 and plate 22 and is attached, at its lower end, to driving point 12. The upper end of rod 24 terminates in an anvil 26 about two inches above the top surface of plate 22.

Pipe casing 40 is fixed to and projects upwardly from plate 22 to define a cylindrical cavity immediately above plate 22. A motor means, namely reciprocating piston mechanism 42 is provided within pipe 40, above anvil 26 such that operation of motor 42 causes piston 44 to strike anvil 26, thus driving rod 24 downwardly through plate 22 and in turn forcing driving point 12 downwardly with respect to plate 22. The resultant vertical displacement of driving point 12 away from plate 22 snaps flexible straps 16 outwardly, driving filter fabric 14 radially and laterally outwardly into the soil surrounding cavity 18. As piston 44 recoils from anvil 26, spring 20 (which is in tension at this point) retracts, drawing driving point 12 upwardly and causing straps 16 to flex inwardly, thus returning fabric 14 to its original relaxed position. It can thus be seen that repetitive actuation of piston 44 causes the volume of cavity 18 to successively expand and contract. Cavity 18 is accordingly termed a "volume change chamber". The fabric 14 serves as a screening means which surrounds at least a portion of the volume change chamber and has sufficient flexibility to deflect radially to provide cyclic displacements which act substantially perpendicularly to the longitudinal axis of the apparatus. Continued operation of motor 42 repeatedly drives piston 44 against anvil 26, causing alternating expansion and contraction of volume change chamber 18, thereby sustaining radially-acting cyclic translations in the region surrounding device 10.

A second pipe casing 50, attached to, and aligned with, pipe casing 40 contains pipe 52 which is secured within pipe 50 by means of spacer 58. The annular space between pipes 50, 52 forms a first conduit 54, while pipe 52 forms a second conduit 56. Motor 42 is air-powered by an external compressed air source (not shown). Compressed air passes to motor 42 through second conduit 56, which serves as a delivery conduit. Air is in turn expelled from motor 42 through passages in piston 44, as indicated by arrows 46, and passes upwardly into first conduit 54, which serves as an exhaust conduit, for ultimate expulsion from device 10.

Air expelled from motor 42 as aforesaid serves as an air-lift pumping mechanism to expel water from within device 10. More particularly, pore water, indicated by arrows 48, in the region surrounding volume change chamber 18 flows essentially perpendicular to the longitudinal axis of device 10, toward device 10, is drawn through filter fabric 14, and then through perforated plate 22, such that the pore water is ultimately extracted from device 10 through first conduit 54, together with the air expelled from motor 42.

In operation, device 10 is positioned on the surface of the sand or silt mass which is to be compacted or densified, with pointed end 12 on that surface. That part of the mass which is to be densified will be saturated or nearly saturated with pressurized pore water. For example, the soil may be partly or completely submerged, or it may be below the water table. Device 10 is normally positioned vertically, but it could be placed at an inclination to the vertical in some cases (for example to densify the side slopes of an underwater fill pile, or to gain access beneath an obstruction such as a structural foundation). Compressed air is fed to motor 42 as aforesaid to repeatedly drive piston 44 against anvil 26, thereby causing driving point 12 to be hammered into the ground, and work device 10 into the sand or silt to the desired depth.

By blocking the air/water discharge outlets (not shown) at the upper end of device 10 during initial penetration of device 10 into the soil, one may cause the compressed air to be discharged outwardly through filter fabric 14, thus loosening the particles which immediately surround device 10 and easing its penetration into the ground. Initial penetration could also be eased by mounting an air or water jet on driving point 12 for activation during initial penetration of device 10 into the soil.

Once device 10 has reached the desired depth, the air/water discharge outlets at the upper end of device 10 are unblocked (if they were initially blocked as aforesaid). Motor 42 continues to reciprocally drive piston 44 against anvil 26, causing alternating expansion and contraction of volume change chamber 18, thereby imposing radially-acting translations in the region surrounding device 10. Continued operation of motor 42 also sustains withdrawal of water from device 10 through first conduit 54, until the sand or silt has been sufficiently densified, at which point device 10 is withdrawn for use elsewhere.

Conventional densification procedures employ vibration to improve the density of sands, whereas consolidation by sustained dead weight loading is employed for improving silts. The present invention employs neither of these conventional practices. Also, the invention enjoys several significant advantages over conventional systems. Firstly, conventional devices are incapable of compacting silt size material because of the time lag between application of the densification energy and the time at which the pore water pressure dissipates sufficiently to allow the particles to come to rest in a tighter packing in the absence of excess water. In contrast, the invention is capable of removing excess water from the soil concurrently with the application of the densification forces, thus allowing silts to behave similarly to sands.

Secondly, the invention extracts water from the soil in a controlled and contained way. The water thus removed from the ground can be captured at the surface, stored and treated, if necessary, before returning it to the groundwater regime.

Thirdly, device 10 may be relatively small (about five feet long), enabling it to be easily manhandled and operated in areas of restricted headroom, such as inside structures. Additional pipe sections could readily be coupled to device 10 in order to transport a sand slurry to the bottom of the region being densified, while the densification effort is underway, thus allowing the volume reduction attending densification to be replenished, and in turn preventing ground surface settlements which are an undesirable byproduct of ground improvement.

Fourthly, the pummelling action of driving point 12 resulting from repetitive hammering of piston 44 against anvil 26, when combined with inward seepage forces accompanying active withdrawal of pore water from the region surrounding device 10, leave dense sand or silt beneath device 10, when device is withdrawn. Conventional vibroflots, when withdrawn, leave a loose column of sand in the region occupied by the apparatus itself.

Fifthly, the aforesaid pummelling action on densified soil directly beneath device 10 tends to force device 10 upwardly once the soil has been sufficiently compacted, thus assisting in automatic withdrawal of device 10 following adequate densification.

As will be apparent to those skilled in the art in the light of the foregoing disclosure, many alterations and modifications are possible in the practice of this invention without departing from the spirit or scope thereof. For example, although the cyclic displacement mechanism (i.e. driving point 12, spring 20, rod 24, and anvil 26) is combined with filter fabric 14 and flexible straps 16 to form a single module located at the bottom of device 10, these functions could alternatively be replaced by two separate elements: a displacement mechanism covered by a rubberized membrane, and a water well screen acting as the intake filter, one being stacked directly above the other. Alternatively, driving point 12 could be shaped so as to cause sub-horizontal radial displacements when driven vertically, with such vertical movement being accommodated by a cylindrical flexible filter cavity positioned above driving point 12. Accordingly, the scope of the invention is to be construed in accordance with the substance defined by the following claims.

What is claimed is:

1. Apparatus for densifying a saturated soil region surrounding said apparatus, said apparatus having a lower section comprising:

(a) densification means for imparting to said region cyclic displacements which act radially and substantially perpendicularly to a longitudinal axis of said apparatus;

(b) flexible screening means for excluding sand and silt particles from said apparatus, while permitting water withdrawal from said region through said screening means, the screening means having sufficient flexibility to deflect radially to provide said cyclic displacements; and, (c) pumping means for continuously expelling water withdrawn from said apparatus.

2. Apparatus as defined in claim 1, wherein said densification means comprises a volume change chamber.

3. Apparatus as defined in claim 2, wherein said screening means surrounds at least a portion of said volume change chamber.

4. Apparatus as defined in claim 2, further comprising motor means in said lower section, for causing cyclic expansion and contraction of said volume change chamber.

5. Apparatus as defined in claim 4, wherein said motor means is air powered.

6. Apparatus as defined in claim 5, wherein said motor means further comprises an air-powered reciprocating piston.

7. Apparatus as defined in claim 6, wherein said piston reciprocates in a direction parallel to said axis.

8. Apparatus as defined in claim 4, further comprising a delivery conduit for conveying energy to said motor means.

9. Apparatus defined in claim 8, wherein said delivery conduit conveys air for energizing said motor means.

10. Apparatus as defined in claim 9, wherein said conduit is further for conveying energy to said pumping means.

11. Apparatus as defined in claim 5, wherein said pumping means comprises air expulsion from said motor means into said water withdrawn through said screening means and wherein said apparatus further comprises a air exhaust conduit for conveying said expelled air and said water out of said apparatus.

12. A method of densifying saturated soil, comprising the steps of:

(a) applying, within a region of said soil, a cyclic radial displacement which acts against soil within said region; and, (b) during application of said displacement, actively withdrawing water from said region toward the source of application of said displacement.

13. A method of densifying a saturated soil, comprising the steps of:

(a) applying, within a region of said soil, a cyclic radial displacement which acts against soil within said region; and, (b) during application of said displacement, controlling release of water from within said soil to a site remote from said region to prevent return of water to source of application of said displacement.

14. A method as claimed in claim 12, further characterised by:

(a) applying said cyclic radial displacement to act subhorizontally within said region.

15. A method as claimed in claim 12, further characterised by:

(a) actively withdrawing water from said region by a pumping action applied to a volume change chamber, a portion of which chamber is subjected to said cyclic radial displacement.

16. A method as claimed in claim 15, further characterised by:

(a) generating said cyclic radial displacement by using an air driven motor supplied with air, and exhausting said air from said motor, (b) actively withdrawing air from said region by using at least some of said air exhausted from said motor.

17. An method as claimed in claim 12, further characterised by:

(a) applying said cyclic displacement to said soil in said region by displacing a flexible screening means against said soil, (b) actively withdrawing the water from the region by applying a pressure difference across the flexible screening means, and excluding sand and silt particles from entering said apparatus, (c) at least partially cleaning said screening means by deflecting said screening means while subjected to said cyclic radial displacement.

18. A method as claimed in claim 13, further comprising:

(a) applying the cyclic radial displacement to act subhorizontally within said region by displacing a flexible screening means against said soil.

19. A method as claimed in claim 18, further characterized by:

(a) actively controlling the release of water from within said soil by applying a pressure different across the flexible screening means, thus tending to draw water towards the source of application of said displacement.

20. A method as claimed in claim 18, further characterised by:

(a) generating said cyclic radial displacement by using at an air driven motor, and exhausting air from said motor, (b) actively withdrawing water through said flexible screening means by using at least some of said air exhausted from said motor to generate said pressure difference.

* * * * *